US006390203B1

(12) United States Patent
Borisov et al.

(10) Patent No.: US 6,390,203 B1
(45) Date of Patent: May 21, 2002

(54) FIRE SUPPRESSION APPARATUS AND METHOD

(76) Inventors: Yulian Y. Borisov, #4 Shvernika ul., Moscow (RU), 117036; David P. Kutchinski, 9 Ashcroft Ct., Boling Brook, IL (US) 60490; John W. Newell, 6506 Loisdale Rd., Suite 209, Springfield, VA (US) 22150; Gary O'Neal, Box 24815, Lakeland, FL (US) 33802

( * ) Notice: Subject to any disclaimer, the term of this patent is extended or adjusted under 35 U.S.C. 154(b) by 0 days.

(21) Appl. No.: 09/480,983

(22) Filed: Jan. 11, 2000

Related U.S. Application Data

(60) Provisional application No. 60/115,317, filed on Jan. 11, 1999, and provisional application No. 60/147,044, filed on Aug. 3, 1999.

(51) Int. Cl.[7] ..... B05B 17/04; B05B 1/08; A62C 37/10; A62C 3/07

(52) U.S. Cl. ..... 169/62; 169/60; 169/61; 239/4; 239/102.1

(58) Field of Search ..... 239/4, 102.1, 589.1; 169/46, 43, 14, 9, 60, 61, 62; 417/379, 381

(56) References Cited

U.S. PATENT DOCUMENTS

| | | | | |
|---|---|---|---|---|
| 3,630,294 A | | 12/1971 | Bouyoucos et al. | 173/136 |
| 3,762,477 A | * | 10/1973 | Mobley, Sr. | 169/14 |
| 4,319,640 A | * | 3/1982 | Brobeil | 169/28 |
| 4,408,719 A | * | 10/1983 | Last | 239/589.1 |
| 5,014,790 A | | 5/1991 | Papavergos | 169/44 |
| 5,441,114 A | | 8/1995 | Spector et al. | 169/14 |
| 5,495,893 A | * | 3/1996 | Roberts et al. | 169/37 |
| 5,697,207 A | * | 12/1997 | Cromer et al. | 60/39.02 |
| 5,934,379 A | * | 8/1999 | Ostlyngen et al. | 169/46 |
| 5,957,210 A | | 9/1999 | Cohrt et al. | 169/44 |
| 5,977,645 A | * | 11/1999 | Glennon | 290/40 |
| 6,006,840 A | | 12/1999 | Sundholm | 169/9 |

* cited by examiner

*Primary Examiner*—Henry C. Yuen
*Assistant Examiner*—Davis Hwu
(74) *Attorney, Agent, or Firm*—Holland & Knight LLP

(57) ABSTRACT

A fire suppression apparatus (10) including a pneumoacoustic atomizer (40) for delivering a mist of water in the form of droplets having a size range between 50–90 microns suspended in a fire suppressing gas such as nitrogen. The supply (12) of fire suppressing gas may be provided by a bottle (16) or a nitrogen generator (14). For airborne applications, the nitrogen generator (14) may be supplied with compressed air bled from a turbine engine (26) of the aircraft. To minimize the consumption of fire suppressing materials, the apparatus (10) may be operated in a pulsed mode, wherein the delivery of fire suppressing materials is interrupted unless a fire sensor (66) detects a fire re-flash. Furthermore, only those atomizers (40) proximate the location of a fire are activated in response to the detection of a fire. To ensure the proper atomization of the water, the opening of a water control valve (44) connected to the atomizer (40) is delayed until a predetermined interval after the opening of the gas control valve (42) for that atomizer (40).

17 Claims, 2 Drawing Sheets

FIRE SUPPRESSION APPARATUS AND METHOD

This application claims the benefit of the Jan. 11, 1999, filing date of U.S. provisional patent application No. 60/115,317, and the Aug. 3, 1999, filing date of U.S. provisional patent application No. 60/147,044.

BACKGROUND OF THE INVENTION

The present invention related generally to fire suppression systems, and more particularly to a non-toxic fire suppression system, and specifically to a non-toxic fire suppression system for use on aircraft.

Many existing fire suppression systems utilize fluroine containing material sold under the trademark Halon. Because this material is thought to be associated with the depletion of the atmospheric ozone layer, there is a desire to find alternative fire suppression materials. In particular, the United States Federal Aviation Administration is testing alternatives for such chemicals in an effort to certify non-toxic, non-ozone depleting fire suppression systems for use on aircraft.

U.S. Pat. No. 6,003,608 issued on Dec. 21, 1999, teaches a fire suppression apparatus and method for an enclosed space that avoids the use of Halon fire-extinguishing material. That patent teaches the introduction of a non-combustible gas into the enclosed space while expelling the air from the space, thereby smothering the fire. The patent also teaches the introduction of a fire extinguishing dry chemical into the space. Such a system does not provide any mechanism for the removal of heat from the protected space, nor does it address the special requirements for long duration protection against re-flash fires. Furthermore, the use of dry fire extinguishing chemicals can complicate the clean-up after a fire and may result in collateral damage to the protected space and any material stored therein.

BRIEF SUMMARY OF THE INVENTION

Thus there is a particular need for a fire suppression system that can be utilized on an aircraft and that is non-toxic and non-ozone depleting. Such a system must be light weight and must be operable for an extended time period to prevent or suppress any fire re-flash. The collateral damage caused by the operation of such a fire suppression system must be minimized.

Accordingly, the fire suppression apparatus and method described herein provide fire suppression through two mechanisms simultaneously: first by depriving the fire of the oxygen necessary for combustion by flooding the area of the fire with a fire suppressing gas such as nitrogen; and second by cooling the fire through the evaporation of droplets of water suspended in the fire suppressing gas. This is accomplished by delivering the nitrogen and water through a pneumoacoustic atomizer having a resonator in which the flow of nitrogen creates acoustic energy sufficient to break the water flow into a mist of droplets having the desired size range. The nitrogen can be supplied from storage bottles or from a nitrogen generator. The nitrogen generator is supplied with compressed air bled from the turbine engine of the aircraft, thereby ensuring the extended term of operability of the fire suppression system. The volume of water and nitrogen used may be further limited by detecting the location of a fire and thereby providing nitrogen and water to only those pneumoacoustic atomizers proximate the fire. The flow of water to the pneumoacoustic atomizer is delayed for a short period following the initiation of the flow of nitrogen in order to ensure that sufficient acoustical resonance is established in the resonator prior to the introduction of the water.

Thus there is described herein a fire suppression apparatus for an airplane, the fire suppression apparatus comprising: a nitrogen supply comprising bottled nitrogen and a nitrogen generator, the nitrogen generator being supplied with compressed air from a turbine engine of the airplane; a water supply; a pneumoacoustic atomizer connected to the nitrogen supply and to the water supply through a nitrogen control valve and a water control valve respectively, the pneumoacoustic atomizer operable to generate a flow of nitrogen containing a mist of water droplets of a predetermined size range when supplied with nitrogen and water from the nitrogen supply and the water supply respectively; a fire detector; a controller having an input from the fire detector and having outputs operable to control the operation of the nitrogen control valve and the water control valve.

There is further described herein a method of suppressing a fire in an airplane, the method comprising the steps of: providing a supply of nitrogen in the airplane, the supply of nitrogen comprising a bottle of nitrogen and a nitrogen generator; providing a supply of water in the airplane; connecting the supply of nitrogen and the supply of water to a pneumoacoustic atomizer operable to generate a mist of water droplets of a predetermined size range in a flow of nitrogen when supplied with nitrogen and water; detecting the presence of a fire in the airplane; directing the mist of water droplets in the flow of nitrogen toward the fire by initiating a flow of nitrogen and water to the pneumoacoustic atomizer from the nitrogen generator and water supply respectively.

DETAILED DESCRIPTION OF THE INVENTION

Figure 1:
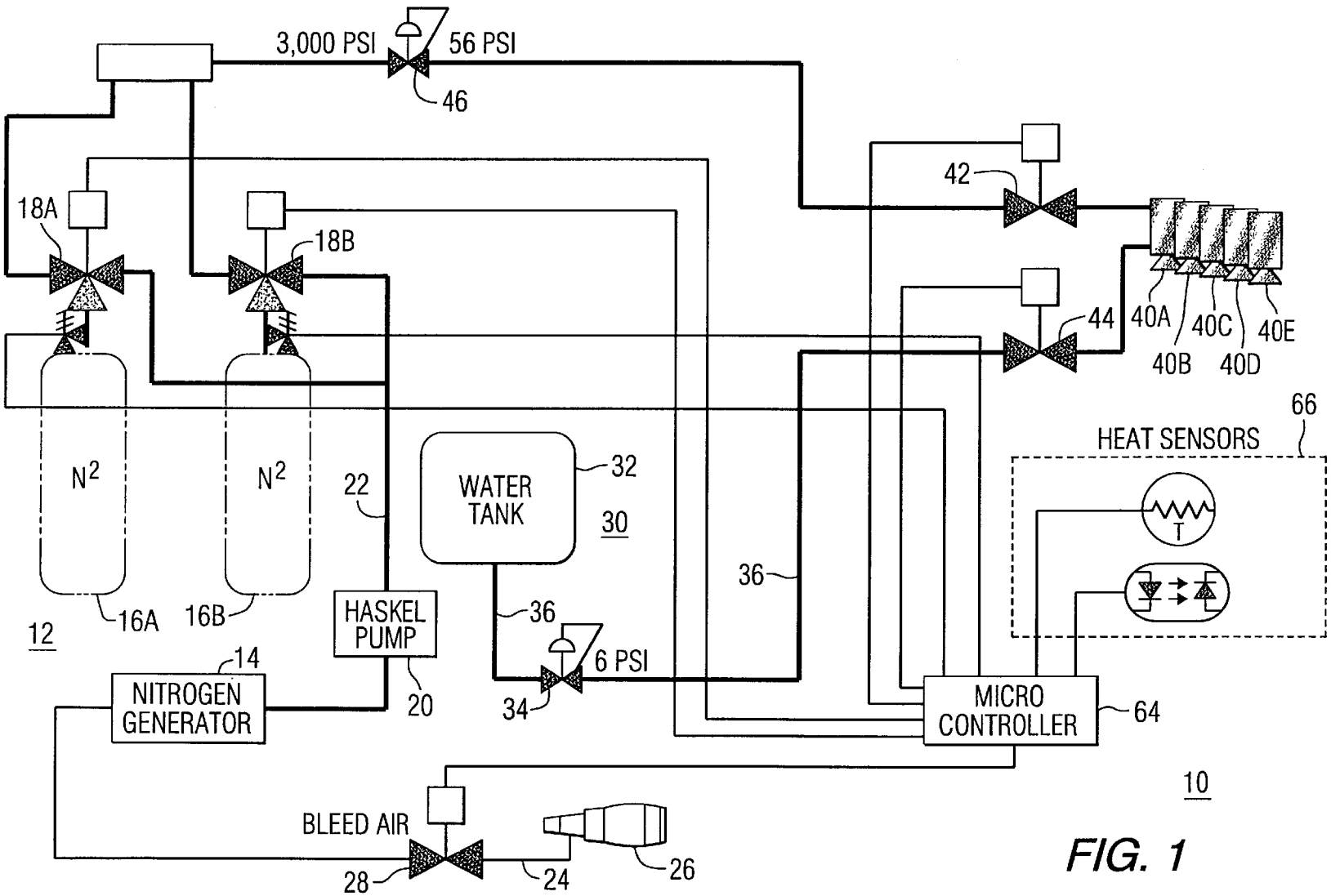
FIG. 1 is a schematic representation of a fire suppression apparatus in accordance with this invention.

FIG. 1 illustrates a fire suppression apparatus 10 as may be installed in an aircraft. The invention is equally useful in other applications requiring non-toxic, long term, remote fire suppression capability, such as for example, space vehicles, land based buildings such as warehouses, manufacturing and storage facilities, hospitals and institutions, complexes, offshore or water borne facilities or locations such as ships, platforms, barges, container ships, etc. The fire suppression apparatus 10 includes a supply 12 of a fire suppressing gas. The fire suppressing gas may be any such gas known to be incapable of supporting combustion, such as an inert gas, nitrogen, nitrogen mixed with less than about 12% oxygen, or other non-combustible gas. FIG. 1 illustrates the supply 12 of fire suppressing gas to include two sources of nitrogen, a nitrogen generator 14 and one or more bottles or tanks 16 (denoted individually in FIG. 1 as 16A and 16B) containing nitrogen under pressure. The nitrogen pressure may be 40–60 psig, or in one embodiment is 56 psig. These sources of nitrogen provide nitrogen with a purity level sufficient to suppress combustion. Alternatively, only one source of nitrogen may be provided, however, for longer term delivery of the fire suppressing materials, both nitrogen sources are desirable. In particular, if the nitrogen generator is incapable of providing the required volume of flow, the tanks 16 serve as accumulators to provide an immediate supply of fire suppressing gas with an adequate flow rate, while the nitrogen generator 14 serves to re-fill the tanks 16. By providing more than one tank/bottle 16, the supply of nitrogen to atomizer 40 can be switched from a depleted tank to a full tank, with the depleted tank then being refilled by operation of the generator.

The tanks 16 may be of any design, with preference given to light weight designs for airborne applications. The volume of nitrogen stored is determined by the requirements of the particular application and may vary depending upon the volume of the area being protected and the time period specified for actuation of the fire suppression apparatus 10. The tanks 16 provide an immediate supply of nitrogen upon demand, however, it may not be practical to store the total volume of nitrogen required by a particular design within tanks 16. To supplement the nitrogen supply in tanks 16, one or more nitrogen generators 14 may be provided. The nitrogen generator 14 may be any such device commercially available, with the selection of a particular device taking into consideration the weight, power requirements and volume capability of the unit for the particular airborne application. In order to increase the pressure of the nitrogen supplied by the nitrogen generator 14, it may be necessary to include a pump 20 in the connection 22 between the nitrogen generator 14 and the three-way valves 18. Pump 20 may be, for example, a Haskel pump powered by compressed air bled from the propulsion turbine of the aircraft. One example of a nitrogen generator that may be used is system part number 75700-1-484 membrane nitrogen generator compressed air pretreatment skid with hydrocarbon removal system and 2200 psig pump, available from Whatman Inc., Tewksbury, Mass. Nitrogen generator 14 may be connected in parallel to the outlet of tanks 16 via three-way valves 18 (denoted individually in FIG. 1 as 18A and 18B). Three-way valves 18 allow nitrogen to be fed from the bottles 16 to the nozzles 40 or for the bottles to be supplied with nitrogen from the nitrogen generator 14 via the pump 20 for recharging.

In order to provide the nitrogen generator 14 with air at a sufficient pressure, the inlet of the nitrogen generator 14 may be advantageously connected to a compressed air bleed 24 taken from a turbine engine 26 used for the propulsion of the aircraft via bleed air control valve 28. Long term availability of a supply 12 of fire suppressing gas is thereby provided by the augmentation of the volume of nitrogen available in the tanks 16 with the production of nitrogen by the nitrogen generator 14. Furthermore, the nitrogen generator 14 may be used to provide the initial fill of nitrogen for tanks 16 through the pump 20. By using two tanks, a first tank may be used to supply the nitrogen during a fire suppression activity, while the second tank is being refilled by the nitrogen generator 14 via pump 20.

Fire suppression apparatus 10 also includes a water supply 30, including a tank 32 for storing a volume of water, a water pressure control valve 34, and water supply lines 36. Tank 32 may serve the additional function as the storage tank for drinking water for passengers on the aircraft, however, preferably, a dedicated water supply 30 is provided for fire suppression apparatus 10. The size of tank 32 is determined by the design requirements of the particular installation. Pressure to drive the water out of tank 32 may be provided by an accumulator, by a pump, or by a connection to the compressed air bleed 24 from the turbine 26 (none illustrated).

At each location requiring fire suppression protection within the aircraft, one or more pneumoacoustic atomizers 40 (separately illustrated in FIG. 1 as 40A, 40B, 40C, 40D and 40E) are provided. Nitrogen from the supply 12 of a fire suppressing gas and water from the water supply 30 are provided to the atomizers 40 via a gas control valve 42 and a water control valve 44 respectively. The nitrogen pressure provided to the gas control valve 42 is controlled by gas pressure control valve 46.

Figure 2:
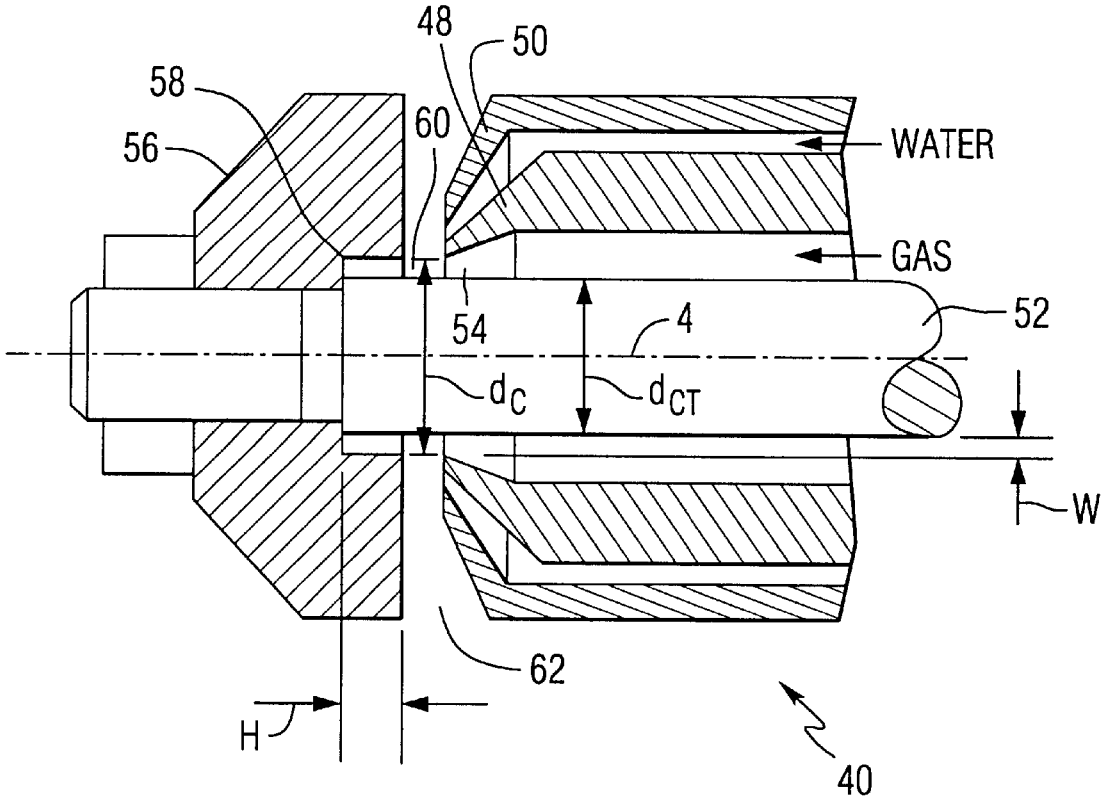
FIG. 2 is a partial cross-sectional view of the pneumoacoustic atomizer illustrated in FIG. 1.

FIG. 2 illustrates a partial cross-sectional view of pneumoacoustic atomizer 40. The atomizer 40 includes a gas nozzle 48, a water nozzle 50, a rod 52, and a ring shaped gap 54 defined between the inside diameter of water nozzle 50 and the outside diameter of rod 52. Atomizer 40 also includes a head 56 and a resonator 58 formed as an open volume between an inside diameter of head 56 and the outside diameter of rod 52. In operation, nitrogen supplied through gas control valve 42 is directed through gas nozzle 48, thereby generating acoustic vibrations having frequencies determined by the width W of gap 54. The nitrogen is directed toward resonator 58, and as it is decelerated by resonator 58, intense acoustic oscillations are excited in the atomization zone 60 between the gas nozzle 48 and the resonator 58. The frequency of these oscillations depend upon the gap width W and the height H of the resonator 58. These acoustic oscillations cause the atomization of water supplied through water nozzle 50 from water control valve 44. The result is the generation of a mist of water droplets of a predetermined size range exiting atomizer 40 through ring shaped outlet 62 in a flow of fire suppressing nitrogen.

It has been found that water droplets of a size range of between 50–90 microns ($\mu$m) are desirable for rapid suppression of fires. It is known that there exists some threshold sound pressure which corresponds to the beginning of the dispersion of liquid during pneumoacoustic atomization. This threshold depends upon many factors, including the surface tension of the liquid, the shape of the initial liquid jet, and the presence of an airflow. For the invention as illustrated herein, the sound pressures required for efficient dispersion of water lie in the range of 160–170 dB, which corresponds to a sound intensity in the atomization zone 60 of 1–10 W/cm. However, the atomization process depends not only on the sound level, but also on the sound frequency, with the size of the resulting droplets decreasing with increasing frequency of acoustic waves (i.e. with decreasing wavelength $\lambda$). It was found that to obtain water droplets in the size range between 50–90 microns, it was necessary to have frequencies of 16–21 kHz.

It is known that for a near-wall ring jet as used in rod-type radiators such as atomizer 40, the unsteady modes formed as a result of the deceleration caused by an empty resonator are realized at Strouhal numbers close to the quarter wavelength resonance, i.e. at $Sh=\Delta/\lambda=0.21–0.23$, where $\Delta$ is the cell length of the supersonic jet and $\lambda=c/f$, (c being the speed of sound in the gas, $\lambda$ is the wavelength, and f is the generation frequency). The cell length is proportional to the width of the nozzle gap $\delta$ and also depends upon both the pressure of the supplied gas (usually within 2.5–5 atmospheres) and the transverse curvature of the out flowing jet. The jet curvature, in turn, is determined by the ratio between the diameter dr of the rod 52 and the diameter dn of the gas nozzle 48. In atomizers designed for fire fighting purposes, the curvature parameter R=dr/dn is usually selected to be within the range of 0.8–0.9. Then, the above mentioned Strouhal numbers are obtained for $\lambda=(0.03–0.055)\lambda$, and the required droplet dimensions can be achieved by using a resonator with the depth determined by the relation $h=(3.0–5.0)\delta$, since the necessary sound pressures of 160–170 dB can be obtained only for these values of h.

Returning to FIG. 1, the fire suppression apparatus 10 also includes a controller 64, such as for example a computer or microprocessor or programmable logic controller or other digital/analog/combination control system. The controller 64 is preferably supplied with a back-up power supply, such as a battery, to assure continued operation in the event of a power outage caused by a fire. Similarly, all active components of the fire suppression apparatus 10 are preferably supplied with back-up power, and/or are powered by a power source other than the primary electrical system of the vehicle/structure being protected. One or more fire detectors, such as temperature sensor 66, provide a fire detection input signal to controller 64. Other types of fire detectors that may be used include smoke detectors, infrared sensors, thermal signature sensors, laser sensors, or other such devices known in the art. During normal operation when the input signal indicates normal temperatures in the area being protected, controller 64 provides output signals to maintain valves 28,42,44 in their closed positions, and valves 18 in position to isolate the tanks 16. Controller 64 may also monitor pressure signals from tanks 16 to ensure that the desired inventory of compressed nitrogen is available and provide an appropriate alarm in the event of an inadequate pressure. In the event of a fire, the fire detection signal from temperature sensor 66 will exceed a predetermined setpoint, and controller 64 will activate the fire suppression response by opening valves 18, 42,44 to provide nitrogen and water to the atomizers 40. A delay circuit incorporated into the logic of controller 64, or included as a separate device associated with water control valve 44, may be included to delay the opening of the water control valve 44 for a predetermined time period, such as 1–2 seconds, after the opening of the gas control valve 42 in order to ensure that the desired dynamic conditions are established in atomization zone 60 prior to the introduction of the water. In one embodiment, the water supply is capable of providing water at two or more pressures, such as for example, 2 psig and 6 psig, such as by the operation of water pressure control valve 34 at two setpoints. For the initial fire extinguishing period, the controller 64 may control the operation of valve 34 to provide water to the atomizer 40 at an initial higher pressure in order to maximize the cooling effect of the water mist. After a predetermined time, or after a fire detection signal such as from temperature sensor 66 reaches a predetermined value, the pressure of the water may be reduced to a second lower pressure. The lower water pressure will result in a dryer mist being supplied to the protected area along with the fire suppressing gas. Using a dryer mist for extended term suppression operation conserves the supply of water in tank 32 as well as reduces the possibility of water damage to the protected area and its contents. This feature is especially useful for airborne or other applications where the supply of water is limited. Similarly, the number of atomizers activated may be reduced after the initial period of operation. In the event that the intensity of the fire again increases, as indicated by the fire detection signal exceeding a predetermined value, the supply pressure for the water and/or the number of activated atomizers may again be increased.

Controller 64 may also be programmed to operate the fire suppression apparatus 10 in a pulsed mode whereby the fire suppressing gas/mist is delivered to the fire for a predetermined time period or only until a predetermined temperature level is sensed by temperature sensor 66. Once the predetermined time period has passed or once the detected temperature measurement drops below the predetermined value, the flow of nitrogen and water to atomizer 40 is terminated. Thereafter, the controller 64 monitors the temperature signal from sensor 66 to detect any rise in the temperature above a predetermined value indicative of a re-flash of the fire. In the event of fire re-flash, the controller 64 re-initiates the delivery of the fire suppressing gas/mist. This cycle may be repeated multiple times. It is also possible to program the duration of the fire suppression spray to be a function of other variables, such as the rate of temperature rise, the rate of temperature reduction, the duration of the time period between detected re-flash events, etc. The goal is to ensure adequate fire suppression with the use of a minimum of fire suppressing materials.

It is desirable to minimize the quantity of fire suppressing materials used for several reasons. Obviously, in airborne and some other applications where space or weight constraints are limiting, there may be only a finite quantity of fire suppressing materials available. Furthermore, there may be collateral damage caused by the accumulation of the fire suppressing material. One benefit of the present invention is that the materials used are non-toxic and will not damage most other materials. Nitrogen is, of course, the major component of air, and will readily mix and disperse with air once the fire protected air space is opened to the environment. Water is also a very benign material, in particular in the form delivered by the present invention, i.e. as a mist of particles having droplet diameters of between 50–90 microns. Most of the water delivered to the fire will be evaporated into steam, thereby absorbing a significant amount of heat energy and providing the desired cooling effect. Any excess water not immediately evaporated will remain as fog and may remain suspended in the gas or may precipitate onto various surfaces in the protected area. In either case, it is likely that the excess water will eventually evaporate without causing any harm to the materials in the protected area.

It is possible to protect a plurality of separate areas with the fire suppression apparatus 10 of this invention. For example, multiple cargo areas of a plane or ship may be protected with one system, with appropriate fire detection sensors 66 and atomizers 40 being located in each such area. A plurality of gas and water control valves 42,44 may be connected to the supply 12 of fire suppressing gas and to the water supply 30 respectively to supply the fire suppressing materials to the respective plurality of pneumoacoustic atomizers 40. Logic or circuitry in the controller 64 connected to receive the plurality of input signals from the respective plurality of fire detectors 66 may function as a means for detecting the location of a fire proximate at least one of the atomizers 40. The controller 64 is then operable to open the gas control valve 42 and water control valve 44 associated with only the at least one of the atomizers 40 proximate the fire. This embodiment of the present invention also serves to minimize the consumption of the fire suppressing materials by delivering them only to those specific protected areas involved with a fire.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A fire suppression apparatus comprising:

a supply of fire suppressing gas comprising a bottle containing a fire suppressing gas and a nitrogen generator;

a water supply;

a pneumoacoustic atomizer connected to the supply of fire suppressing gas and to the water supply, the pneumoacoustic atomizer operable to generate a mist of water droplets of a predetermined size range in a flow of fire suppressing gas when supplied with fire suppressing gas and water from by the supply of fire suppressing gas and the water supply respectively;

a means for controlling the supply of fire suppressing gas and water to the pneumoacoustic atomizer in response to the presence of a fire; and a connection between the nitrogen generator and the bottle for re-filling the bottle with nitrogen during periods when fire suppressing gas is not being supplied from the bottle to the pneumoacoustic atomizer, the connection between the nitrogen generator and the bottle comprising a three-way valve connected to an inlet of the pneumoacoustic atomizer, to an outlet of the nitrogen generator, and to the bottle.

2. A fire suppression apparatus comprising:

a supply of fire suppressing gas comprising a bottle containing a fire suppressing gas and a nitrogen generator;

a water supply;

a pneumoacoustic atomizer connected to the supply of fire suppressing gas and to the water supply, the pneumoacoustic atomizer operable to generate a mist of water droplets of a predetermined size range in a flow of fire suppressing gas when supplied with fire suppressing gas and water from by the supply of fire suppressing gas and the water supply respectively;

a means for controlling the supply of fire suppressing gas and water to the pneumoacoustic atomizer in response to the presence of a fire including:

a temperature sensor operable to generate a temperature signal;

a gas control valve connected between the supply of fire suppressing gas and the pneumoacoustic atomizer;

a water control valve connected between the water supply and the pneumoacoustic atomizer;

a controller having the temperature signal as an input and having outputs connected to the gas control valve and the water control valve, the controller operable to open the gas control valve and the water control valve in response to the temperature signal exceeding a predetermined value; and a delay circuit connected to the water control valve and operable to delay the opening of the water control valve for a predetermined time period after the opening of the gas control valve; and a connection between the nitrogen generator and the bottle for re-filling the bottle with nitrogen during periods when fire suppressing gas is not being supplied from the bottle to the pneumoacoustic atomizer.

3. A fire suppression apparatus comprising:

a supply of fire suppressing gas comprising a bottle containing a fire suppressing gas and a nitrogen generator;

a water supply operable to supply water at a first pressure and at a second pressure lower than the first pressure;

a pneumoacoustic atomizer connected to the supply of fire suppressing gas and to the water supply, the pneumoacoustic atomizer operable to generate a mist of water droplets of a predetermined size range in a flow of fire suppressing gas when supplied with fire suppressing gas and water from by the supply of fire suppressing gas and the water supply respectively;

a means for controlling the supply of fire suppressing gas and water to the pneumoacoustic atomizer in response to the presence of a fire, said means for controlling being operable to control the pressure of the supply of water to the pneumoacoustic atomizer to be alternatively the first pressure and the second pressure; and a connection between the nitrogen generator and the bottle for re-filling the bottle with nitrogen during periods when fire suppressing gas is not being supplied from the bottle to the pneumoacoustic atomizer.

4. A fire suppression apparatus for an airplane, the fire suppression apparatus comprising:

a nitrogen supply comprising bottled nitrogen and a nitrogen generator, the nitrogen generator being supplied with compressed air from a compressed air bleed from a turbine engine of the airplane:

a water supply;

a pneumoacoustic atomizer connected to the nitrogen supply and to the water supply through a nitrogen control valve and a water control valve respectively, the pneumoacoustic atomizer operable to generate a flow of nitrogen containing a mist of water droplets of a predetermined size range when supplied with nitrogen and water from the nitrogen supply and the water supply respectively;

a fire detector;

a controller having an input from the fire detector and having outputs operable to control the operation of the nitrogen control valve and the water control valve; and a delay circuit connected to the water control valve and operable to delay the opening of the water control valve for a predetermined time period after the opening of the nitrogen control valve.

5. A fire suppression apparatus for an airplane, the fire suppression apparatus comprising:

a nitrogen supply comprising bottled nitrogen and a nitrogen generator, the nitrogen generator being supplied with compressed air from a compressed air bleed from a turbine engine of the airplane and comprising a three-way valve connected to the inlet of the pneumoacoustic atomizer, an outlet of a nitrogen storage bottle, and an outlet of the nitrogen generator;

a water supply;

a pneumoacoustic atomizer connected to the nitrogen supply and to the water supply through a nitrogen control valve and a water control valve respectively, the pneumoacoustic atomizer operable to generate a flow of nitrogen containing a mist of water droplets of a predetermined size range when supplied with nitrogen and water from the nitrogen supply and the water supply respectively;

a fire detector;

a controller having an input from the fire detector and having outputs operable to control the operation of the nitrogen control valve and the water control valve.

6. The fire suppression apparatus of claim 5, further comprising a pump connected between the outlet of the nitrogen generator and the three-way valve, the pump being driven by compressed air bled from the turbine engine.

7. A fire suppression apparatus for an airplane, the fire suppression apparatus comprising:

a nitrogen supply comprising bottled nitrogen and a nitrogen generator, the nitrogen generator being supplied with compressed air from a compressed air bleed from a turbine engine of the airplane;

a water supply operable to supply water at a first pressure and at a second pressure lower than the first pressure;

a pneumoacoustic atomizer connected to the nitrogen supply and to the water supply through a nitrogen control valve and a water control valve respectively, the pneumoacoustic atomizer operable to generate a flow of nitrogen containing a mist of water droplets of a predetermined size range when supplied with nitrogen and water from the nitrogen supply and the water supply respectively;

a fire detector; and a controller having an input from the fire detector and having outputs operable to control the operation of the nitrogen control valve and the water control valve, the controller being operable to control the pressure of the water supplied to the pneumoacoustic atomizer to be alternatively the first pressure and the second pressure.

8. A method of suppressing a fire in an airplane, the method comprising:

providing a supply of nitrogen in the airplane, the supply of nitrogen comprising a bottle of nitrogen and a nitrogen generator;

providing a supply of compressed air to the nitrogen generator from an air bleed connection on a turbine engine of the airplane;

providing a supply of water in the airplane at a first pressure and at a second pressure lower than the first pressure;

connecting the supply of nitrogen and the supply of water to a pneumoacoustic atomizer operable to generate a mist of water droplets of a predetermined size range in a flow of nitrogen when supplied with nitrogen and water;

detecting the presence of a fire in the airplane;

directing the mist of water droplets in the flow of nitrogen toward the fire by initiating a flow of nitrogen and water to the pneumoacoustic atomizer from the supply of nitrogen and the supply of water respectively, the step of directing the mist of water droplets comprising initiating a flow of water at the first pressure for an initial period; and reducing the pressure of the supply of water to the second pressure subsequent to the initial period.

9. The fire suppression method of claim 8, further comprising the step of controlling the pressure of the supply of water in response to a fire detection measurement.

10. A method of suppressing a fire in an airplane, the method comprising:

providing a supply of nitrogen in the airplane, the supply of nitrogen comprising a bottle of nitrogen and a nitrogen generator;

providing a supply of compressed air to the nitrogen generator from an air bleed connection on a turbine engine of the airplane;

providing a supply of water in the airplane;

connecting the supply of nitrogen and the supply of water to a pneumoacoustic atomizer operable to generate a mist of water droplets of a predetermined size range in a flow of nitrogen when supplied with nitrogen and water;

detecting the presence of a fire in the airplane;

directing the mist of water droplets in the flow of nitrogen toward the fire by initiating a flow of nitrogen and water to the pneumoacoustic atomizer from the supply of nitrogen and the supply of water respectively; and delaying the initiation of the flow of water for a predetermined period after the initiation of the flow of nitrogen.

11. A method of suppressing a fire in an airplane, the method comprising:

providing a supply of nitrogen in the airplane, the supply of nitrogen comprising a bottle of nitrogen and a nitrogen generator;

providing a supply of compressed air to the nitrogen generator from an air bleed connection on a turbine engine of the airplane;

providing a supply of water in the airplane;

connecting the supply of nitrogen and the supply of water to a pneumoacoustic atomizer operable to generate a mist of water droplets of a predetermined size range in a flow of nitrogen when supplied with nitrogen and water;

detecting the presence of a fire in the airplane;

directing the mist of water droplets in the flow of nitrogen toward the fire by initiating a flow of nitrogen and water to the pneumoacoustic atomizer from the supply of nitrogen and the supply of water respectively; and providing a three-way valve for connecting the bottle alternatively to the pneumoacoustic atomizer and to the output of the nitrogen generator.

12. A method of suppressing a fire over an extended time period, the method comprising the steps of:

providing a supply of nitrogen comprising at least two bottles of nitrogen and a nitrogen generator;

providing a supply of water;

connecting the supply of nitrogen and the supply of water to an atomizer operable to generate a mist of water droplets of a predetermined size range in a flow of nitrogen when supplied with nitrogen and water;

detecting the presence of a fire;

directing the mist of water droplets in the flow of nitrogen toward the fire by initiating a flow of nitrogen and water to the atomizer from the supply of nitrogen and the supply of water respectively;

supplying nitrogen to the atomizer from alternative ones of the bottles of nitrogen while supplying nitrogen from the nitrogen generator to the ones of the bottles not supplying nitrogen to the atomizer to re-fill the bottles.

13. The fire suppression method of claim 12, further comprising the steps of:

providing the supply of water at a first pressure and at a second pressure lower than the first pressure;

directing the mist of water droplets by initiating a flow of water at the first pressure for an initial period; and reducing the pressure of the supply of water to the second pressure subsequent to the initial period.

14. The fire suppression method of claim 13, further comprising the step of controlling the pressure of the supply of water in response to a fire detection measurement.

15. The fire suppression method of claim 12, further comprising delaying the initiation of the flow of water for a predetermined period after the initiation of the flow of nitrogen.

16. The fire suppression method of claim 12, further comprising providing a three-way valve for connecting the bottle alternatively to the pneumoacoustic atomizer and to the output of the nitrogen generator.

17. The fire suppression method of claim 12, further comprising providing compressed air to the nitrogen generator from an air bleed from a turbine engine.

* * * * *